United States Patent [19]

Zilkha

[11] Patent Number: 4,624,072

[45] Date of Patent: Nov. 25, 1986

[54] ADJUSTABLE SECURITY WINDOW GATE

[76] Inventor: Uri Zilkha, 330 Third Ave., New York, N.Y. 10016

[21] Appl. No.: 722,514

[22] Filed: Apr. 12, 1985

[51] Int. Cl.[4] ..... E06B 3/68

[52] U.S. Cl. ..... 49/55; 49/50

[58] Field of Search ..... 49/50, 54, 55, 56, 57, 49/51, 52, 53; 52/632, 207, 126.3, 126.4; 160/374, 180

[56] References Cited

U.S. PATENT DOCUMENTS

| | | | |
|---|---|---|---|
| 704,992 | 7/1902 | Warner | 160/180 |
| 958,481 | 5/1910 | Drinkwater | 49/55 |
| 1,186,139 | 6/1916 | Shipley | 49/55 |
| 2,175,903 | 10/1939 | Lichtman | 49/55 |
| 2,701,927 | 2/1955 | Dyer | 49/55 |
| 2,819,500 | 1/1958 | Saber | 49/55 |
| 2,982,579 | 5/1961 | Greenwald | 49/55 |
| 3,738,062 | 6/1973 | Ughi | 49/55 |
| 3,978,614 | 9/1976 | Goldhaber | 49/55 |
| 4,465,262 | 8/1984 | Itri | 49/55 |

*Primary Examiner*—William E. Lyddane
*Assistant Examiner*—Gerald A. Anderson
*Attorney, Agent, or Firm*—Charles E. Temko

[57] ABSTRACT

A security window gate including a generally rectangular frame, and a swingable selectively locked gate associated therewith. Adjustment means is provided to permit a given sized gate to be installed within a range of rectangular window sizes without loss of tamper-proof ability. In a vertical direction, steel bars are provided with telescopic elements supported between a pair of adjacent parallel frame members. In a horizontal direction, an adjustable plate-like member of generally L-shaped cross section is provided with elongated slots for bolting to the frame element, the plate being cut to required length, if necessary, at the time of installation.

1 Claim, 4 Drawing Figures

ADJUSTABLE SECURITY WINDOW GATE

BACKGROUND OF THE INVENTION

This invention relates generally to security gates of a type disclosed in my prior U.S. Pat. No. 4,274,228 granted June 28, 1981, and more particularly to an improved adjustable form thereof which can be manufactured on a mass produced basis, such that a relatively few number of standard sizes will fit a majority of sizes of rectangularly shaped window casement openings, adjustment in overall dimensions being performed at the site at the time of installation.

Because of considerations of mechanical strength, the incorporation of adjustable components has not been readily possible in the prior art. As a result, most security gates of the instant type have been manufactured on an individual custom basis with attendant high cost. In addition, even where the gate has been made to order, problems have arisen at the installation site where the window openings are not, for a variety of reasons, fully rectangular, and makeshift adjustments are necessary.

SUMMARY OF THE INVENTION

Briefly stated, the invention contemplates the provision of an improved security gate of the above identified type, in which the accompanying disadvantages have been substantially eliminated. One vertical side of the gate is provided with an adjustable frame element capable of relative lateral movement prior to being fixed in position to fill a gap existing between a fixed frame element and the vertical side of a window opening. The length or height of the adjustable frame element extends to a point corresponding to maximum extension of a second adjustable element extending at right angles to the direction of movement of the adjustable frame element, and may be cut to required size when vertical adjustment has been determined. The fixed frame element also includes an upper vertically adjustable component including telescoping vertically arranged bars which, upon installation, is secured to the upper horizontal surface of a window opening. All outwardly exposed surfaces of the device prevent a smooth exterior devoid of tool engaging surfaces which could be used by an intruder.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
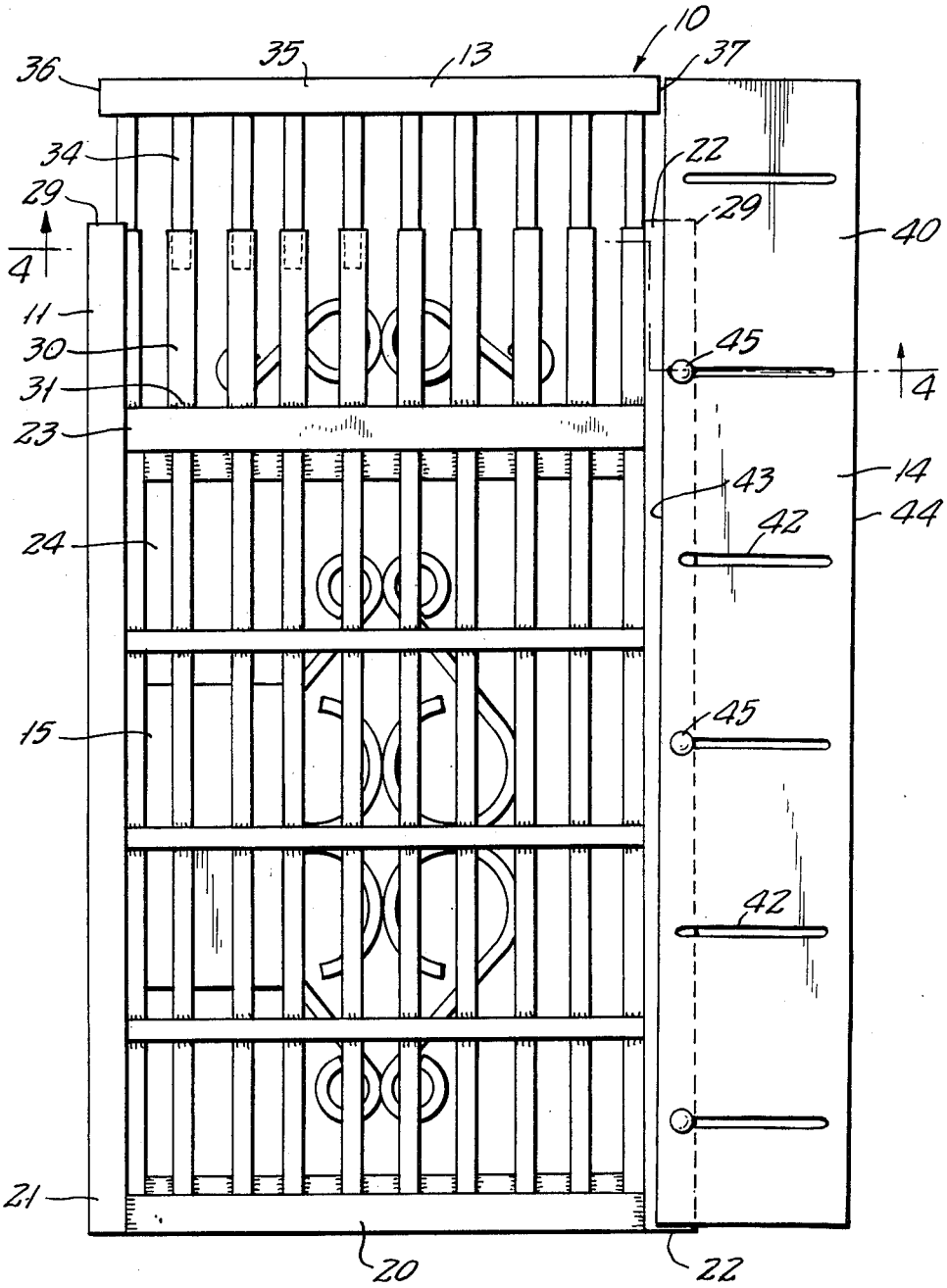
FIG. 1 is a front elevational view of an adjustable security gate embodying the invention.

In accordance with the invention, the device, generally indicated by reference character 10, comprises broadly: a fixed frame element 11, a first vertically adjustable element 13, a second horizontally adjustable element 14, and a hingedly mounted gate element 15.

Figure 4:
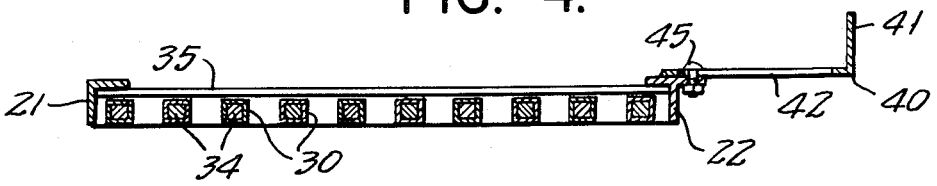
FIG. 4 is a horizontal sectional view as seen from the plane 4—4 in FIG. 2.

The fixed frame element 11 is fabricated in known manner from rectilinear pieces of angle iron, and includes a lower frame member 20, first and second side members 21 and 22, respectively, and an upper frame member 23 defining a rectangular opening 24 in which the gate element 15 is mounted. The second side member 22 has an additional portion 25 to provide a "T"-shaped cross section upon which the adjustable element 14 is mounted (see FIG. 4). The side members 21 and 22 both extend past the upper frame member 23 and terminate in ends 29.

The vertically adjustable element 13 serves to determine the effective height of the device 10, and can be adjusted over a range of several inches. It includes a series of hollow tubes 30, the lower ends 31 of which are welded to an upper surface 32 of the member 23. The upper ends thereof are open and engage corresponding tubes 34, carried by a fifth horizontally extending member 35 between first and second ends 36–37 thereof.

The horizontally adjustable element 14 is adjustably carried by side member 22 and is also of L-shaped cross section. It includes a planar shield member 40 and an angularly disposed mounting member 41. Extending across the member 40 are a plurality of parallel slotted openings 42 between edges 43 and 44. These are engaged by carriage bolts 45 which also penetrate openings 46 in the member 22 (See FIG. 4).

The gate element 15 is substantially similar to that disclosed in my above-mentioned prior patent, and includes a rectangular frame 50 bounded by an upper member 51, a lower member 52, a first side member 53 carrying hinge means 54 and a second side member 55 mounting a rectangular plate 56 in turn carrying bolt means 57 having a shield 58, and engaging a projection 59 on the member 21, as disclosed in said patent. Enclosed by the frame 50 are horizontal and vertical bars 60 and 61 and optional decorative elements 62, which may also be carried by the tubes 30.

Installation is a relatively uncomplicated matter. As seen in the drawing, both the vertically adjustable element 13 and horizontally adjustable element 14 are capable not only of longitudinal and lateral movement, but a substantial degree of canting movement as well in order to adapt to window openings which are other than accurately rectangular.

Figure 2:
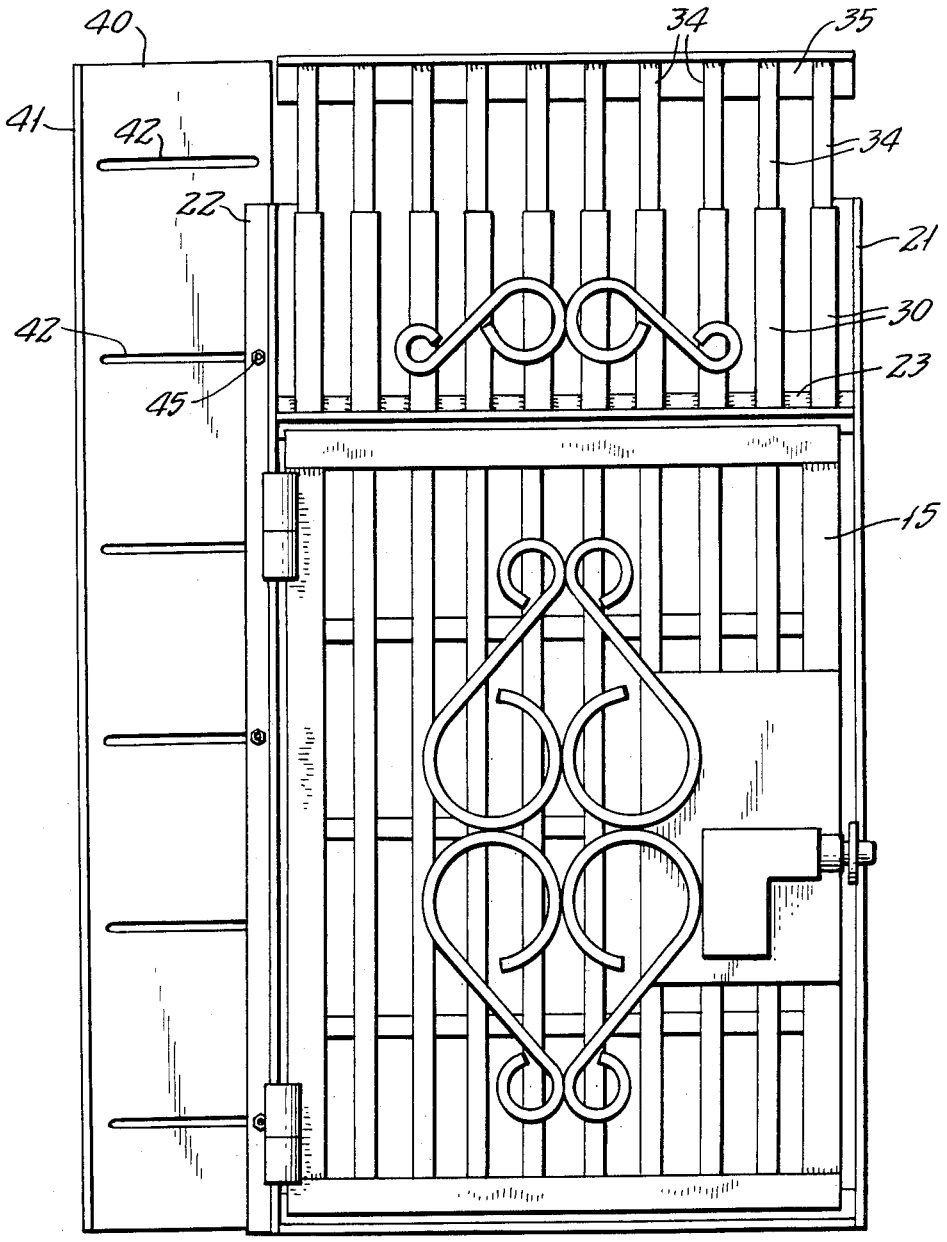
FIG. 2 is a rear elevational view thereof.
Figure 3:
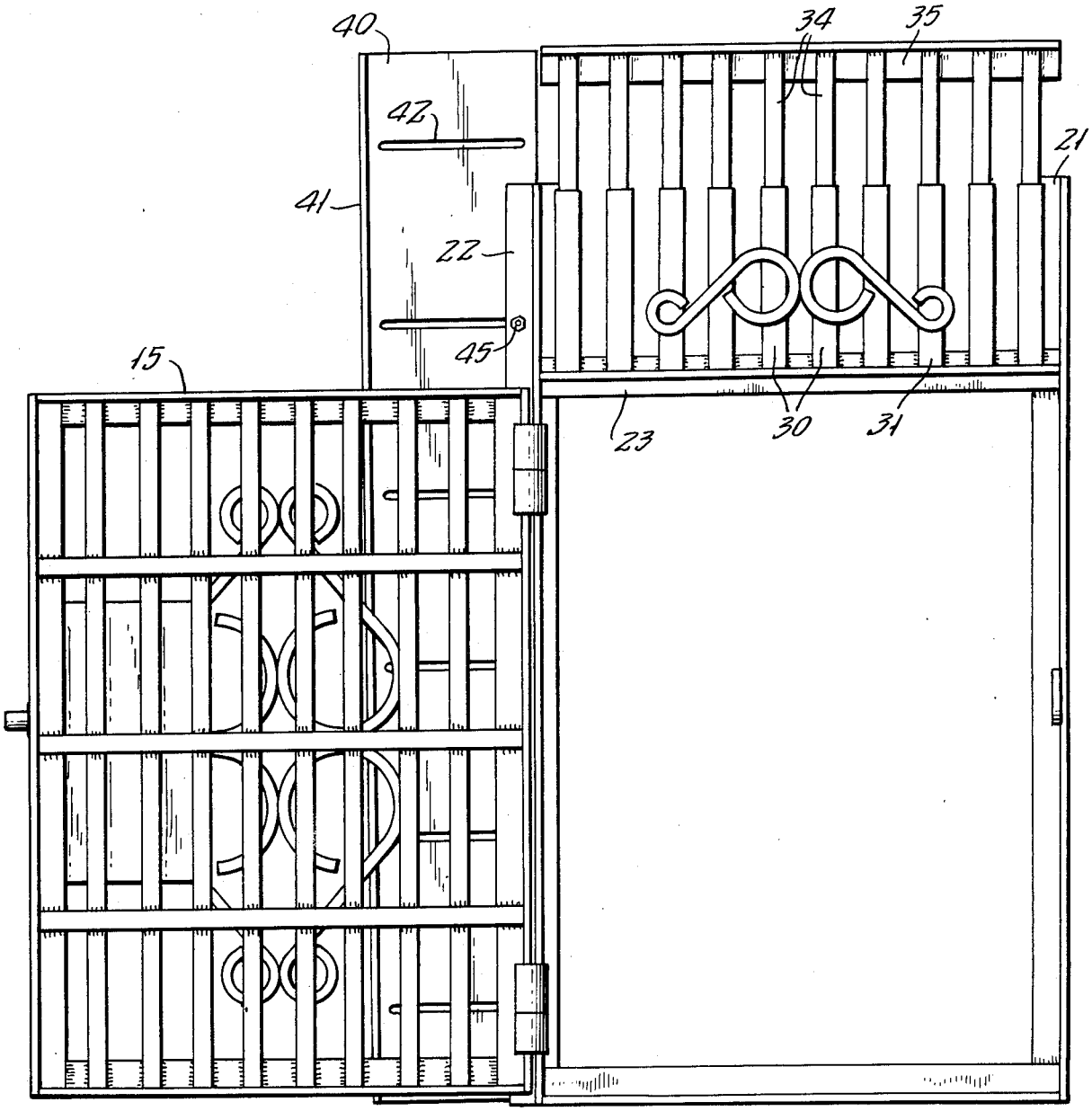
FIG. 3 is a second rear elevational view thereof showing certain of the component parts in altered relative position.

Installation is commenced by placing the device 10 within the window opening (not shown) with elements 13 and 14 in fully retracted condition. Should the window be of a height of lesser dimension than the length of the element 14, the excess can be marked and cut off, using a hacksaw or similar tool. It may then be remounted on the fixed frame element using the carriage bolts 45. Once repositioned within the window opening, the vertically adjustable element 13 is expanded so that member 29 contacts the upper edge of the window opening, to be secured using lag bolts or the like. A similar operation is performed at the bottom and right-hand side as seen in FIG. 2, and the member 41 is secured to the opposite vertical side of the window opening. The carriage bolts 45 may then be finally tightened, to provide a rigid unit. It will be observed that the rectilinearity of the opening 24 maintained, and the lower edge thereof will be parallel to the lower edge of the window opening, so that the gate element 15 may be opened without difficulty.

If desired, the slotted openings 42 may be closed by providing an additional plate (not shown) bolted to the inner surface of the member 40, although in the case of most installations, I have not found this to be necessary.

I wish it to be understood that I do not consider the invention to be limited to the precise details of structure shown and set forth in this specification, for obvious modifications will occur to those skilled in the art to which invention pertains.

I claim:

1. In an approved adjustable window security gate of a type including a relatively fixed frame and a gate element hingedly mounted thereon, the improvement comprising: said fixed frame element having first and second adjustable elements selecively movable in the plane of said frame element in first and second mutually perpendicular directions to contact a pair of corresponding mutually angularly disposed surfaces of a window opening, whereby said gate may be selectively installed in rectangular window openings over a range of dimensions; said fixed frame element including four mutually perpendicular frame members, one of said adjustable elements comprising a first plurality of hollow tubes, each having a first end secured to one of said frame members, a fifth frame member generally parallel to said last-mentioned one of said frame members, a second plurality of tubes, each having first ends secured to said fifth frame member, and extending laterally therefrom, each of said second plurality of tubes being slidably disposed in telescoping manner within a corresponding one of said first plurality of tubes, whereby to adjustably determine the effective dimension of said fixed frame element upon installation thereof within a window opening.

* * * * *